United States Patent [19]

Rekow

[11] Patent Number: 4,884,702

[45] Date of Patent: Dec. 5, 1989

[54] DISPLAY RACK

[76] Inventor: John A. Rekow, 23755 Anderson La., Newberg, Oreg. 97132

[21] Appl. No.: 279,728

[22] Filed: Dec. 5, 1988

[51] Int. Cl.[4] ..... A47F 5/00

[52] U.S. Cl. ..... 211/90; 211/87; 211/106; 211/181; 211/189; 248/222.2; 248/249

[58] Field of Search ..... 211/87, 90, 193, 181, 211/119, 103, 106, 189, 208, 190, 187; 248/222.2, 220.2., 220.3, 249

[56] References Cited

U.S. PATENT DOCUMENTS

| | | | |
|---|---|---|---|
| 3,659,722 | 5/1972 | Carroll | 248/249 X |
| 4,106,736 | 8/1978 | Becker et al. | 248/222.2 |
| 4,579,308 | 4/1986 | Jensen | 211/87 X |
| 4,586,618 | 5/1986 | Norman | 211/181 |
| 4,697,712 | 10/1987 | Jaliulis | 248/243 X |
| 4,730,740 | 3/1988 | Winter et al. | 211/189 |

FOREIGN PATENT DOCUMENTS

| | | | |
|---|---|---|---|
| 6606178 | 11/1966 | Netherlands | 211/106 |
| 6607163 | 12/1966 | Netherlands | 211/106 |

*Primary Examiner*—Robert W. Gibson, Jr.
*Attorney, Agent, or Firm*—James D. Givnan, Jr.

[57] ABSTRACT

A rack for freestanding use or wall installation having several pairs of horizontal rods which receive inserted brackets of various types of supports for merchandise. Vertical stiffeners are spaced apart along the rods to prevent rod displacement. A shelf assembly includes a wire bracket and a shelf having an offset rear edge for locking engagement with a pair of rods. A modified form of rack is mountable directly to a wall surface.

4 Claims, 1 Drawing Sheet

DISPLAY RACK

BACKGROUND OF THE INVENTION

The present invention pertains generally to racks of the type used for the display of merchandise in a store.

Known freestanding display racks do not permit convenient installation or rack accessories for the display of clothing and small platforms for the display of footwear or other such small items. For the most part, clothing is displayed on freestanding racks intended solely for such use as opposed to racks in place along a wall of the store. Accordingly store wall space is not fully utilized for rack installation for the display of various items such as clothing and footwear. In the prior art are grooved wall panels which receive Z-shaped brackets of article supporting accessories.

SUMMARY OF THE PRESENT INVENTION

The present invention is embodied in a rack for freestanding or wall mounted use for the reception of a wide range of arm and shelf accessories.

The present rack may be made in modular form and wall mounted or freestanding which in the latter instance permits both sides of the rack to be utilized for the support of shelves, arms, hooks, waterfall displays, etc.,. A gridwork is formed from pairs of horizontal bars and vertical stiffeners with the bars paired in a closely spaced manner. Adjacent pairs of bars serve to receive an upper, insertable end of a support while a subjacent pair of bars serves as a rest for the support.

A shelf of the present rack includes a rearward edge which includes an offset portion which engages one of the horizontal rods to retain the shelf against inadvertent dislodgment. A wire support member projects forwardly below the shelf to bear shelf loads.

Important objectives include the provision of a display rack for use in various store locations and capable of displaying both shelf and arm supported articles in a wide variety of locations; the provision of a display rack which may be wall mounted or freestanding, the latter mode permitting use of both sides of the rack to support various displays of merchandise; the provision of a display rack having a shelf assembly attachable in various selected locations to the rack without requiring fastening means; the provision of a shelf assembly including a shelf component adapted along one edge for locking engagement with other components of the display rack.

DETAILED DESCRIPTION OF THE PREFERRED EMBODIMENT

Figures 1, 2, 3:
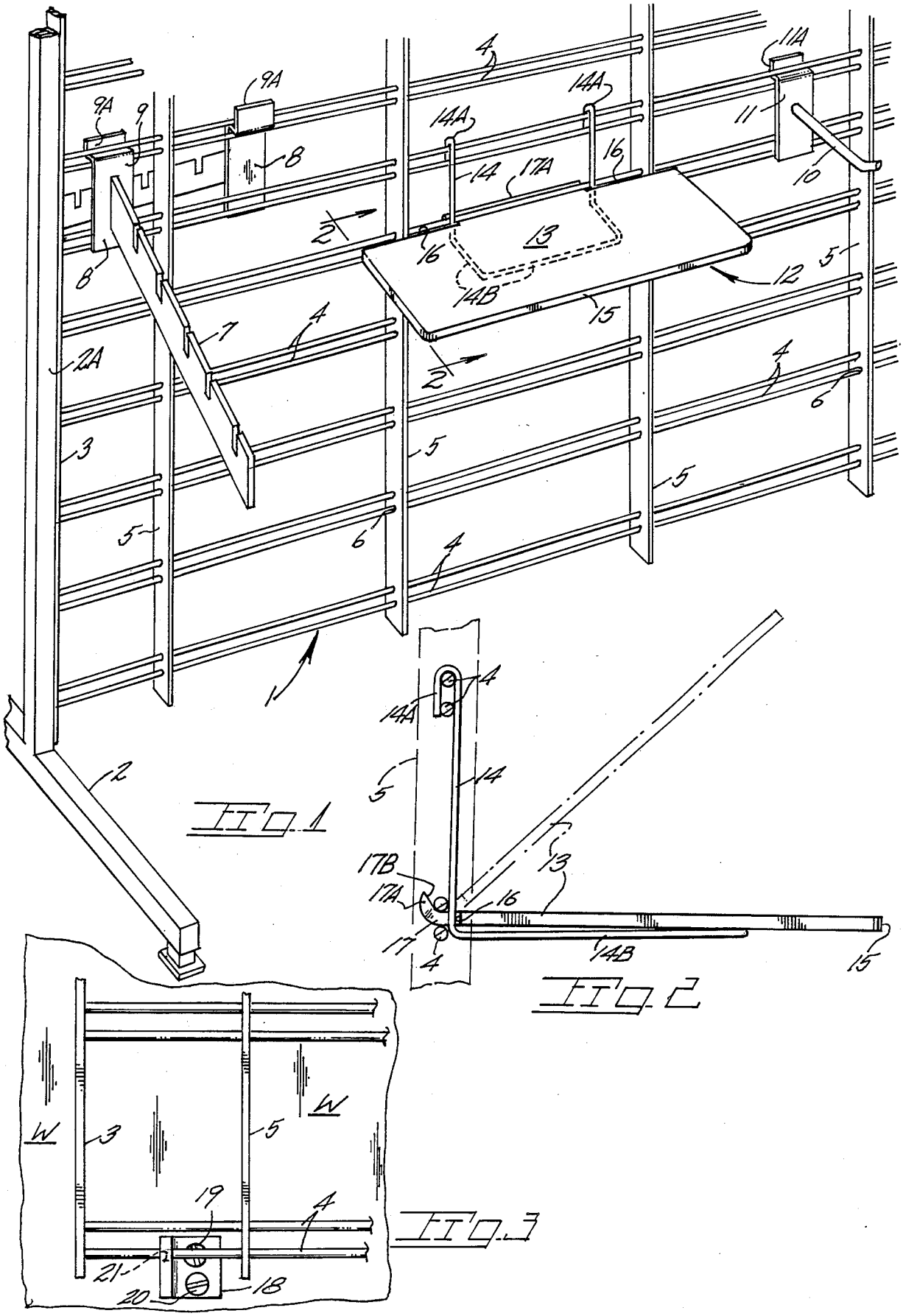
FIG. 1 is a fragmentary perspective view of the present rack with an assortment of display components in place thereon.
FIG. 2 is a horizontal sectional view taken along line 2—2 of FIG. 1.
FIG. 3 is a fragmentary front elevational view of a wall mounted rack.

With continuing attention to the drawing wherein applied reference numerals indicate parts similarly hereinafter identified, the reference numeral 1 indicates generally the present rack shown supported in a freestanding manner by end mounted inverted T stands as at 2.

Attached to a stand upright at 2A is a vertical end member 3 of the present rack. Extending between the end members 3 are pairs of horizontally disposed, closely spaced rods 4. Located at spaced apart intervals of pairs of rods 4 are vertical stiffeners 5 each apertures as at 6 for rod passage. Adjacent pairs of rods serve to support various type of display hardware or accessories as, for example, a waterfall arm 7 having a bracket 8. Bracket 8 is of Z-shape with an upright segment 9 and an angular extension 9A adapted for insertion between the paired rods 4. Additional rack hardware may include display hooks at 10 supported by the bracket identified at 11 having an angular portion 11A for insertion between rods 4.

Indicated generally at 12 is a shelf assembly including a shelf 13 which may be of any size to best suit the display purposes at hand. A shaped wire bracket at 14 is preferably formed from heavy gauge wire with inverted hook shaped upper ends at 14A for placement on a pair of rods. Vertical segments of the bracket extend downwardly and thence forwardly and horizontally to provide a horizontal bracket segment 14B below the shelf. Shelf 13 has an outer or frontal edge 15 and a rearward pair of edges 16.

Shelf 13 includes a rearwardly projecting flange 17 which terminates in an offset portion 17A. When the shelf is disposed horizontally, as viewed in FIG. 2, the offset portion 17A with inclined surface 17B thereon prevents forward shelf movement and shelf separation from the bars 4. The weight of an article displayed contributes to maintaining shelf in horizontal locked relationship with the rack proper. Separation of shelf 13 from the rack proper is accomplished by upward inclination of the shelf. From the foregoing it will be seen that the shelf assembly may be manually relocated and securely reattached to the rack all without the use of any tools.

In FIG. 3 the rack 3 is attached directly to a room wall W by means of wall mounted angle shaped members as at 18 wall attached by fasteners at 19 and 20. The lower rod of certain pairs of rods 4 sits in a groove 21 to permit gravitational installation and removal of the rack without the use of tools.

The present rack may also receive brackets of the Z-type as used with Peg-Board (a registered trademark) walls with the Z portion inserted between a pair of rods 4.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A store display rack comprising in combination, mounting means for floor installation, upright end members for attachment to said mounting means, pairs of horizontal rods vertically spaced from one another and carried by said end members, vertical stiffeners at points along said rods, bracket means for supporting articles to be displayed, said bracket means having an upright segment for rested engagement with a pair of said horizontal rods and an upper end segment offset from said upright segment so as to engage and be supported by a superjacent pair of rods, and a shelf, said shelf including edge structure having an offset portion insertable between a pair of said rods, said shelf supported by said bracket means and the last mentioned pair of rods.

2. The display rack claimed in claim 1 wherein said bracket means includes a horizontal bracket segment subjacent said shelf.

3. The display rack claimed in claim 2 wherein said offset portion includes an inclined surface to engage one of said at least mentioned pair of rods to prevent unintentional shelf separation from the pair of rods.

4. A store display rack comprising in combination, mounting means for installation on a wall, upright end members, pairs of horizontal rods vertically spaced from one another and carried by said end members, vertical stiffeners at points along said rods, bracket means for supporting articles to be displayed, said bracket means having an upright segment for rested engagement with a pair of said horizontal rods and an upper end segment offset from said upright segment so as to engage and be supported by a superjacent pair of rods, a shelf including edge structure having an offset portion insertable between a pair of said rods, said shelf supported by said bracket means and the last mentioned pair of rods, and said mounting means comprising members each defining a recess into which one of said horizontal rods may be placed.

* * * * *